US005564987A

United States Patent [19]

Ayrolles

[11] Patent Number: 5,564,987

[45] Date of Patent: Oct. 15, 1996

[54] FOLDING SWING HAMMOCK

[75] Inventor: Patrice Ayrolles, LaFouillouse, France

[73] Assignee: Societe Industrie et Sport S.A., France

[21] Appl. No.: 505,174

[22] PCT Filed: Sep. 27, 1994

[86] PCT No.: PCT/FR94/01122

§ 371 Date: Aug. 11, 1995

§ 102(e) Date: Aug. 11, 1995

[87] PCT Pub. No.: WO95/26151

PCT Pub. Date: Oct. 5, 1995

[30] Foreign Application Priority Data

Mar. 25, 1994 [FR] France ..... 94 04120

[51] Int. Cl.[6] ..... A63G 9/00

[52] U.S. Cl. ..... 472/118; 472/125; 297/281; 5/124; 5/128

[58] Field of Search ..... 472/118, 120, 472/124, 125; 297/281, 273, 277, 282; 5/124, 127, 128, 129, 102, 103, 98.3; 248/166

[56] References Cited

U.S. PATENT DOCUMENTS 1,229,537 6/1917 Sisbower et al. ..... 5/127

2,547,891 4/1951 Smith ..... 297/281

4,325,578 4/1982 Borucki ..... 297/281

4,537,392 8/1985 Defibaugh .

5,046,203 9/1991 de Cuadros ..... 5/128

FOREIGN PATENT DOCUMENTS 885881 of 1961 United Kingdom .

*Primary Examiner*—Kien T. Nguyen

*Attorney, Agent, or Firm*—Harris Beach & Wilcox, LLP

[57] ABSTRACT

A folding swing hammock that has a main rectangular support frame that is held in a generally vertical position by leg members when the hammock is in an unfolded condition. A rectangular seat frame is rotatably supported between two support arms which, in turn, are suspended by springs in the top element of the support frame. A cover is rotatably mounted in the top section of the support frame over the seat frame. The interrelated parts of the hammock are connected together so that they can all be folded into the plane described by the support frame.

6 Claims, 4 Drawing Sheets

FOLDING SWING HAMMOCK

BACKGROUND OF THE INVENTION

The invention relates to the technical field of garden furniture and, more particularly, swing hammocks.

Swing hammocks that allow two or three persons, or sometimes more, to rest and relax are widely used as part of the amenities in gardens, parks or rest areas.

Known swing hammocks as shown in FIG. 1 are made from bracing generally comprising two triangular-shaped side frames joined at their top which can accommodate a hinged, orientable cover covered with fabric. Struts link the frames to afford stability.

A swing hammock designed in this way accommodates bracing forming a seat capable of being fitted with cushions or other padded furnishings. This bracing may be made of one or two parts with a back rest part and a seat part. The back rest part is generally in a plane inclined of the order of 100° to 120° with respect to the plane of the seat in order to make it comfortable for the user(s).

The position of the back rest part may sometimes be slightly adjustable with respect to the plane of the seat thanks to, for example, means of the small chain and link shaft type allowing appropriate variation as required.

This type of swing hammock nevertheless has disadvantages, particularly when it is stored and because of its overall dimensions. When it is not in use and stored in garages or other similar locations, this type of swing hammock is cumbersome. In addition, users tend to regard the seating area as a makeshift additional storage area for a very wide range of articles and there is therefore a significant risk of dirtying the fabric cover which can adversely affect the appearance and therefore the attractiveness of the swing hammock.

It has also been observed that such swing hammocks can only be moved by the efforts of two persons given the overall dimensions of the hammock assembly. For this reason, users permanently leave swing hammocks in environments that may be harmful to their quality and attractiveness. Humidity, rain and wind borne plant matter are sources of contamination, and fungal growth and colour fading are factors which diminish the attractiveness of such garden furniture.

SUMMARY OF THE INVENTION

The object of the invention was therefore to overcome these disadvantages by suggesting a new folding swing hammock design that is easy to manufacture and assemble, compact and which can easily be carried by a single person.

Another object sought after was to devise a new seat design on such a swing hammock offering a different level of comfort.

According to a first characteristic of the invention, the swing hammock is distinctive:

in that it comprises a rectangular frame fitted with tubular elements forming the longitudinal and horizontal sides and defining a ground support area and an upper area for hinging a cover;

and in that the curved ends of the elements make it possible to fit and rotate intermediate tubes in order to together form the lateral and transverse sides of the frame, and in that L-section elements are separately mounted and fixed with respect to the intermediate tubes by a connecting part whereas the side frames extend as ground support parts;

and in that the seat part consists of rectangular tubular bracing that swivels relative to the L-section support arms suspended in relation to the frame, said seat part having a swivel movement that is limited relative to the arms, said seat part accommodating a canvas or similar material forming a hammock.

These objects and others will become apparent from the following description. The object of the present invention is described, merely by way of example, in the accompanying drawings in which.

DESCRIPTION OF THE INVENTION

Figure 1:
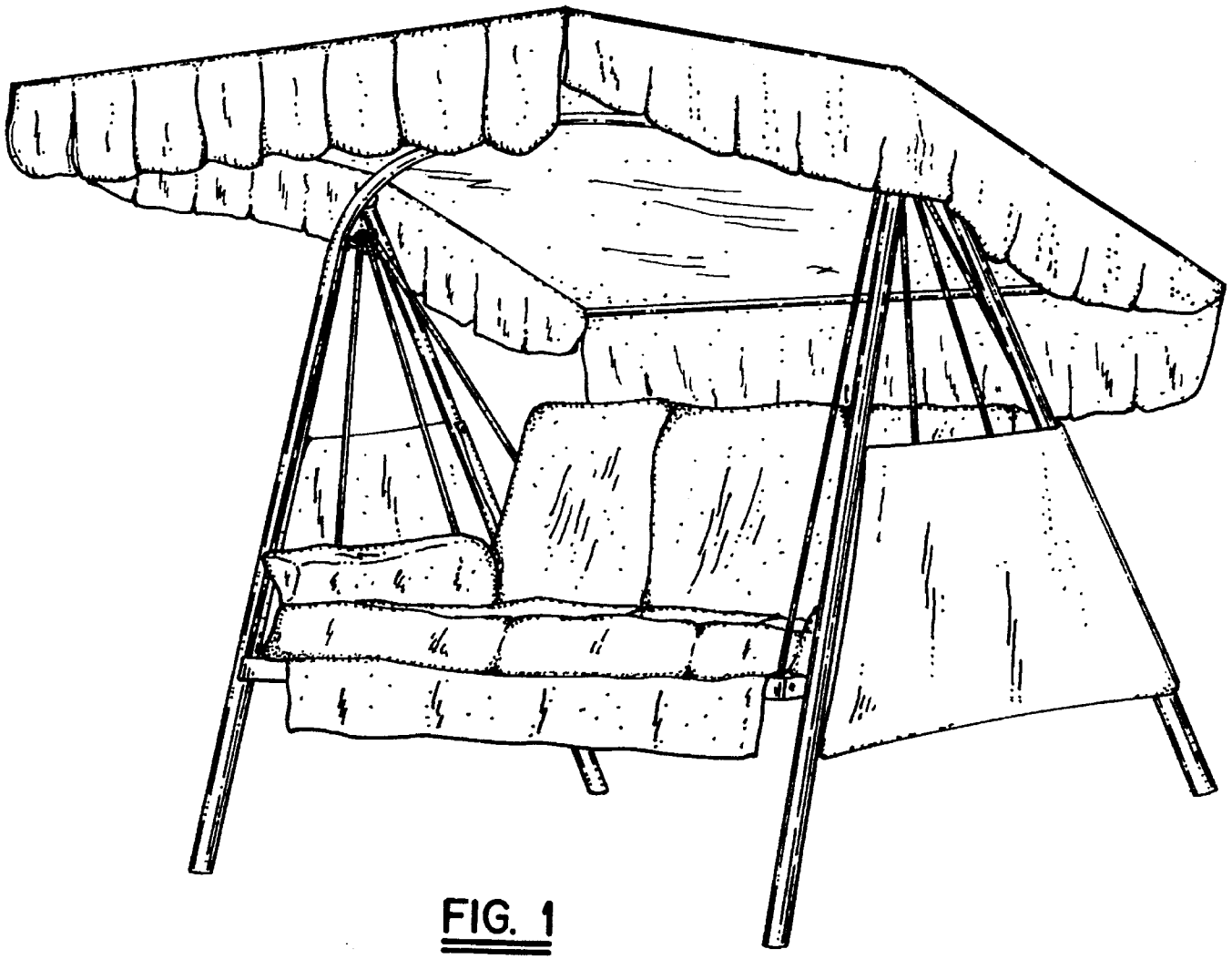
FIG. 1 (PRIOR ART)
FIG. 1 is a schematic perspective view showing a swing hammock of prior art.

In order that the present invention may more readily be understood, the following description is given, merely by way of example, reference being made to the accompanying drawings.

The swing hammock according to the invention is referred to in its entirety by (1). It comprises a rectangular frame (2) corresponding essentially to the desired length of the swing hammock and the desired height of its cover (C). This frame is composed of tubular elements (2.1) and (2.2) forming the longitudinal and horizontal sides and defining a ground support area (2.1.*a*) and an upper area (2.1.*b*) for hinging the cover. Each of these very long elements (2.1, 2.2) has curved ends (2.1.*c* or 2.2.*c*) angled at 90° with respect to each other defining areas where the lateral sides are fitted in. These elements are arranged at a certain distance from each other and make it possible to adapt intermediate tubes (3) that make up the lateral and transverse sides, the ends of these tubes receiving sleeves (3.1) that fit inside the curved ends of the longitudinal sides (2.1, 2.2). After fitting them in, the intermediate tubes go in as far as the stop against edges opposite said curved ends.

In this way one obtains free, swivel mounting of tubes (3) with respect to longitudinal sides (2) and the curved ends (2.1.*c*, 2.2.*c*).

In order to ensure the stability of main frame (2) designed in this way, L-section side frames, of which one part (4.1) is fixed by screws, bolts (5) or the equivalent to intermediate tubes (3) mounted laterally on the frame are provided and fixed. The lower part of each L-section (4) has a very long arm (4.2) situated in an angular plane with respect to the frame forming the support plane of the assembly, the end part (4.3) being curved so that it comes into contact with the ground.

Thus, the swing hammock is made stable when the frame rests against the ground and when the L-section side frames are opened to form a 3-point support area. The L-section side frames can thus swivel over 90° with respect to the lateral sides of frame (2) and either be deployed open at 90° or swivel within the internal plane of the frame.

The seat part (6) ideally consists of rectangular tubular bracing with rounded bend angles (6.1), the bracing being produced so that it fits into the internal volume of the frame of the swing hammock. This bracing is held in position by being suspended by L-section arms (7) of which the upper end (7.1) is hooked and suspended by means of return spring (8) from the upper longitudinal side (2.2) of frame (2). The front part of the arms (7.2) are located in the same plane as the bracing forming the seat (6) during normal use of the swing hammock.

The bracing forming the seat is hinged relative to part (7.2) of suspension arm (7) with respect to an axis of rotation (9) over a given limit of swivel. More particularly, there is provision to place profiled tabs (10) on the transverse sides of the seat bracing (6) that protrude externally and rest against either the upper front part of support arm (7.2) or against rear vertical part (7.1) for suspending the support arm. These tabs are separately mounted in any appropriate way and are used to limit the angular clearance of the bracing forming the seat.

The shape of the seat is devised to accommodate a furnishing made of fabric or other materials (11) thus forming a hammock. This furnishing can be fixed in any appropriate manner so that it can be removed if necessary for cleaning or replacement. The width of the fabric used defines the depth of the seat.

In order to make the assembly sufficiently strong, connecting struts (12) may be separately mounted between the lower part of the framework and the side frame. In a special way, these struts are fixed to the swivelling part of intermediate tubes (3) so that they move together with the side frames when the swing hammock is folded up.

The upper part of the frame makes it possible to position a hinged cover (C) covered with fabric or other protective, decorative material.

Figure 2:
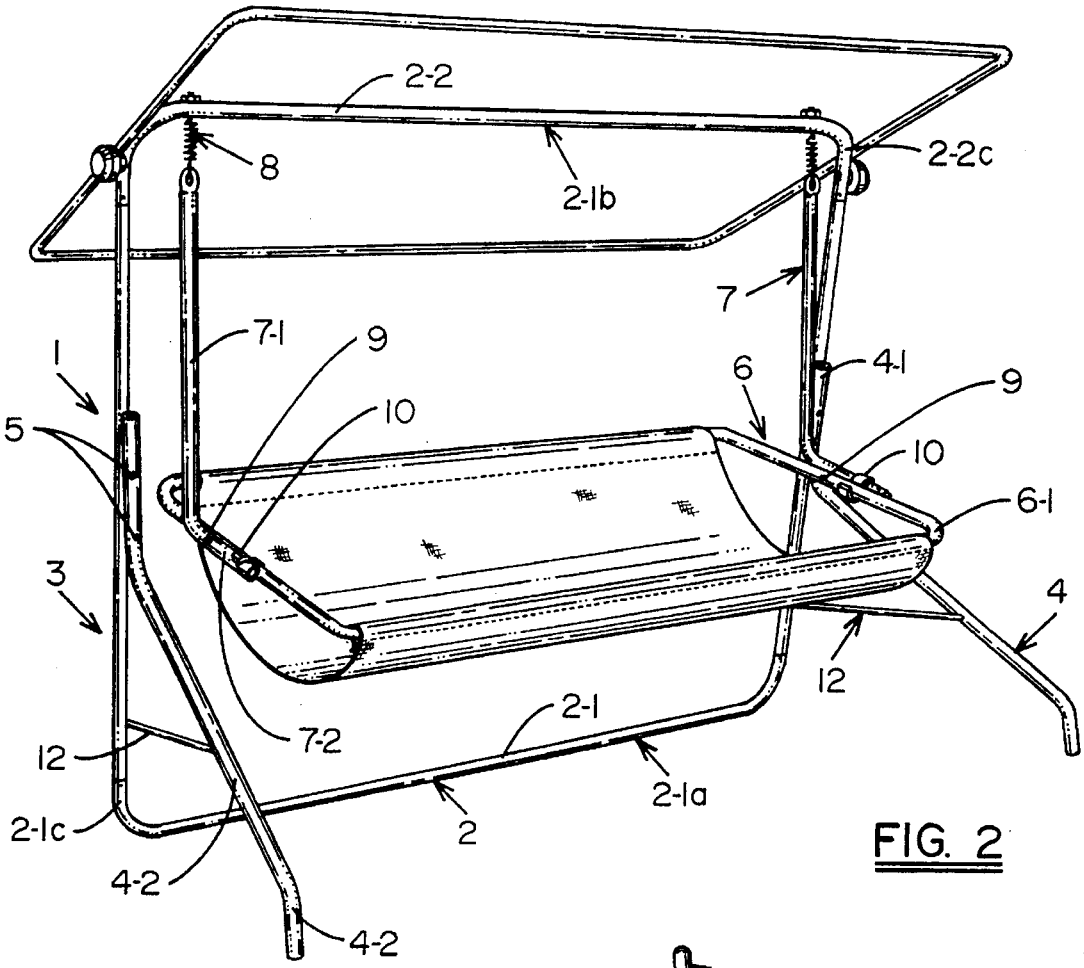
FIG. 2 is a perspective view showing a folding swing hammock according to the invention.
Figure 3:
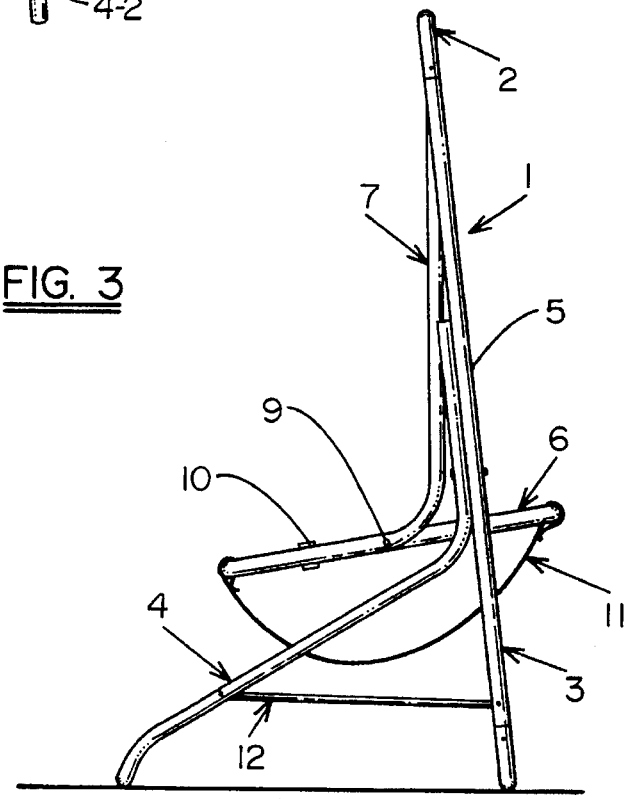
FIG. 3 is a side view according to FIG. 2.
Figure 4:
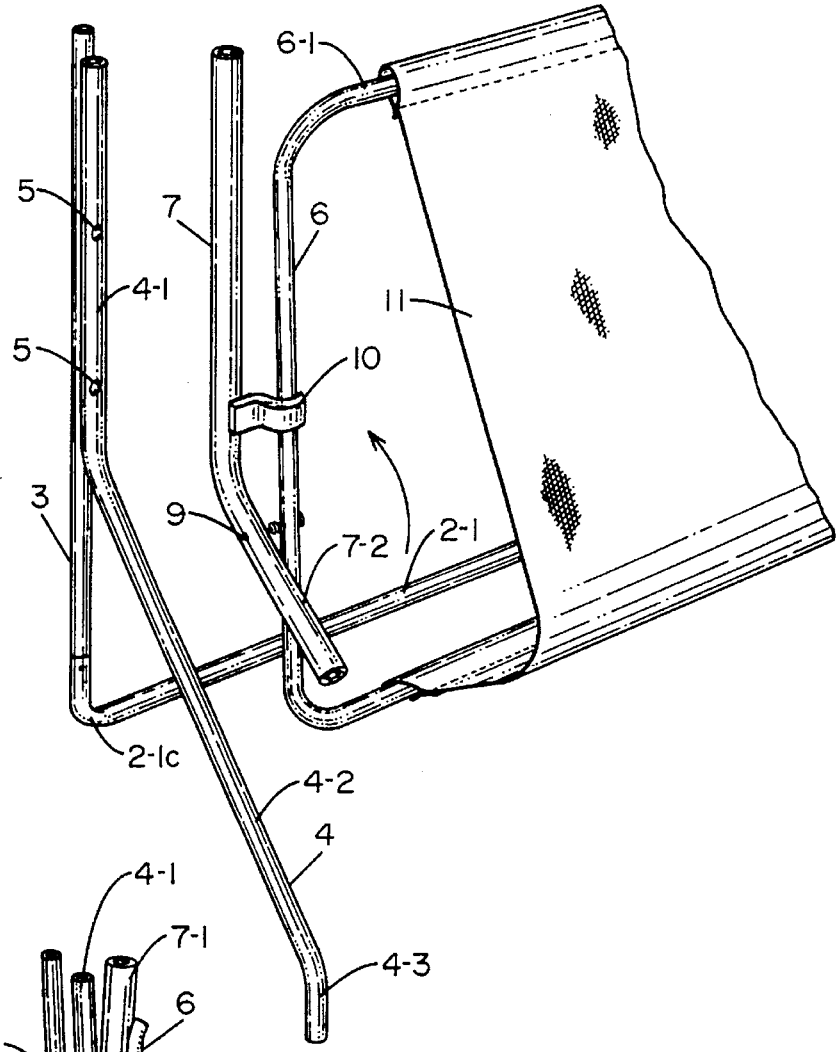
FIG. 4 is a partial side view showing lifting of the seat structure so that the swing hammock can be folded up.
Figure 5:
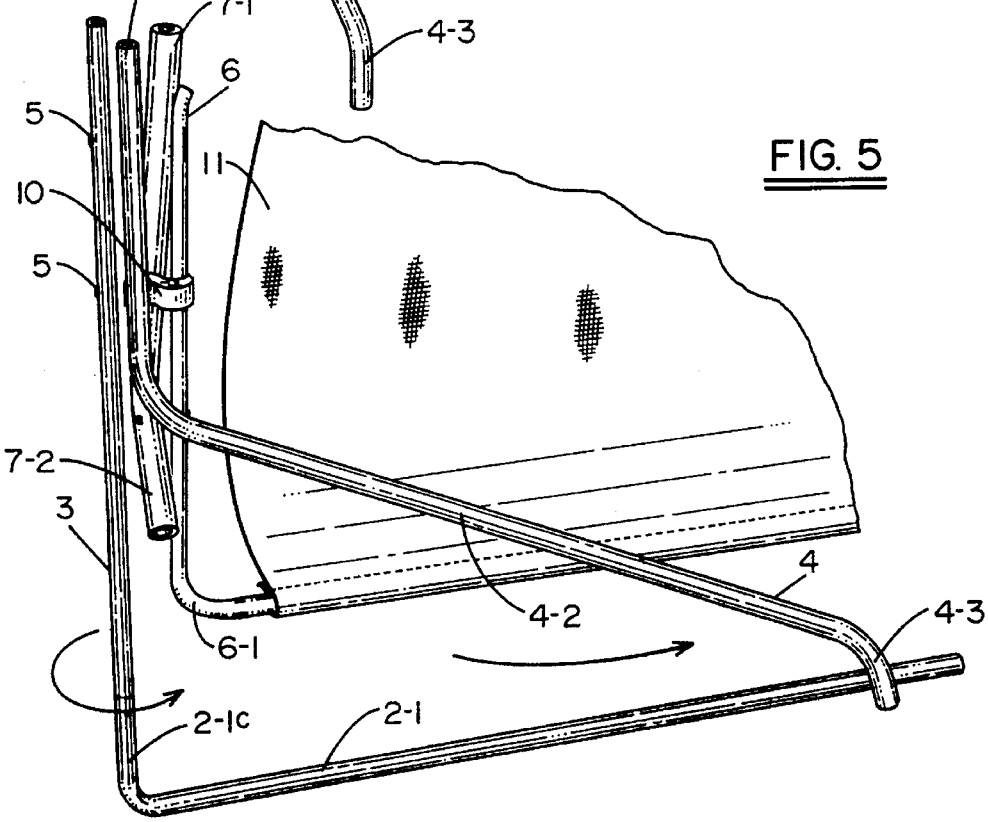
FIG. 5 is a view showing the swing hammock being folded up by partially swivelling its front frame.
Figure 6:
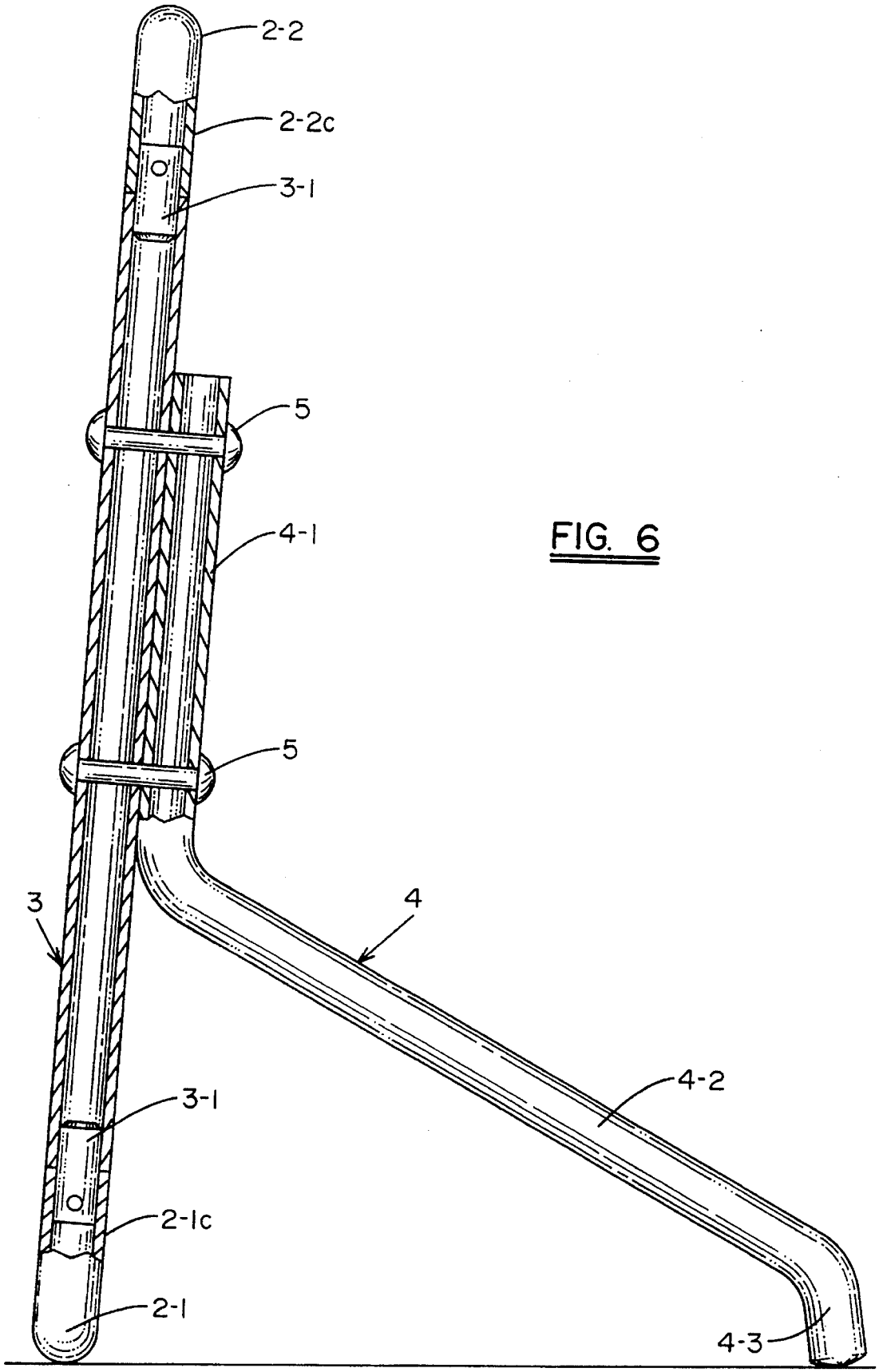
FIG. 6 is a partial sectional view showing the swivel connection of the front side frame relative to the frame or main bracing of the swing hammock.

One should now explain the method of using this type of swing hammock. In its position of use, it is in the configuration shown in FIG. 2. In order to fold it up, the user first raises the support bracing forming a seat (6) until the side tabs (10) come to stop against the vertical or essentially vertical part of suspension arm (7). The side frames (4) are then swivelled and this simultaneously causes rotation of intermediate tubes (3) of the frame until the side frames move into a plane that is essentially underneath the internal volume of the frame. Due to this rotation effect, they then lock the bracing forming the seat in position. The cover is then swivelled.

Hinging of the side frames also causes accompanying movement of the connecting struts and this makes the assembly rigid.

The advantages of the invention are clearly apparent and, in particular, the ease of assembly and disassembly of the swing hammock, its extreme compactness, its low cost price and the new type of hammock seat which is original compared with the prior art are emphasised. The ease with which one person can move the folded-up swing hammock by picking it up at various points, particularly by its seat frame, in order to transport it is also emphasised.

I claim:

1. A folding swing hammock that includes a rectangular support frame having spaced apart side elements and spaced apart top and bottom elements, said bottom element providing ground support for said frame, said side elements being mounted for rotation in said top and bottom element of the frame, a tubular leg member mounted on each of the side elements of the frame that project outwardly and downwardly from the side element to provide further ground support for said frame whereby the frame is supportable in a generally vertical plane when resting upon the ground, a rectangular tubular seat frame suspended from the top element of the support frame by a pair of spaced apart arms, said arms being connected to the top element of the frame by spring means, a seat means mounted in said seat frame, and a cover means hingedly mounted in the top section of the support frame.

2. The hammock of claim 1 that further includes tubular corner elements for connecting the side elements of the support frame to the top and bottom elements, said side elements being rotatable in said corner elements.

3. The hammock of claim 2 wherein said leg members are secured to the side elements of the support frame by threaded fasteners.

4. The hammock of claim 3 that further includes a connecting strut extending between each support leg and one of the side elements.

5. The hammock of claim 1 wherein said support arms are L-shaped members, each having an elongated section connected to the top element of the support frame and a foreshortened section in which the seat frame is rotatably mounted.

6. The hammock of claim 5 wherein said seat frame has stop tabs outwardly extended from opposing sides of said seat frame, said tabs being arranged to engage the foreshortened section of the support arms when the hammock is in a first unfolded position and the elongated section of the support arm when the hammock is in a second folded position.

* * * * *